US007510365B2

(12) United States Patent
Babiarz

(10) Patent No.: US 7,510,365 B2
(45) Date of Patent: Mar. 31, 2009

(54) BULK MATERIALS BAGGER AND METHOD

(76) Inventor: Stacey A. Babiarz, 350 Lake Shore Dr., Edgerton, WI (US) 53534

( * ) Notice: Subject to any disclaimer, the term of this patent is extended or adjusted under 35 U.S.C. 154(b) by 259 days.

(21) Appl. No.: 11/406,196

(22) Filed: Apr. 14, 2006

(65) Prior Publication Data

US 2007/0243053 A1 Oct. 18, 2007

(51) Int. Cl.
*E02F 3/00* (2006.01)

(52) U.S. Cl. ..... 414/725; 414/526; 37/903

(58) Field of Classification Search ..... 414/526, 414/725; 222/272, 412, 413; 198/307.1, 198/314, 318, 509, 659, 662, 669, 676, 677, 198/701; 141/313, 314, 256, 231, 114, 10; 37/403, 903; 180/53.3
See application file for complete search history.

(56) References Cited

U.S. PATENT DOCUMENTS 3,912,092 A * 10/1975 Bolton et al. ..... 414/486
4,274,455 A * 6/1981 Simons ..... 141/1
4,358,241 A * 11/1982 Anderson ..... 414/703
5,152,357 A * 10/1992 McLean et al. ..... 180/53.3
5,311,961 A * 5/1994 Stabenow ..... 180/271
5,564,886 A * 10/1996 Emerson et al. ..... 414/725
5,592,760 A * 1/1997 Kohout ..... 37/403
5,827,038 A * 10/1998 Barden ..... 414/725
5,848,871 A * 12/1998 Thiessen ..... 414/607
2006/0151057 A1* 7/2006 Sweningson ..... 141/114

OTHER PUBLICATIONS

Megga Bagger, www.themeggabaggercorp.com/meggap.html, pp. 1&2.
Megga Bagger, www.themeggabaggercorp.com, pp. 1&2.

* cited by examiner

*Primary Examiner*—Donald Underwood
(74) *Attorney, Agent, or Firm*—Ryndak & Suri LLP

(57) ABSTRACT

An apparatus and method for packaging bulk materials into containers. The apparatus and method are useful in the bagging of bulk products, such as sand, salt, grain, feed and the like, and is particularly useful in rapidly forming sandbags. The bags can be filled at a remote location. The apparatus may be attached to a vehicle, such as a skid steer, tractor or truck, and can replace an existing bucket of a front end loader. The bucket scoops a quantity of bulk material into the bucket. An auger mounted in the bucket is driven by a motor to force a flow stream of bulk material out an opening in the bucket. An open container is placed adjacent the flow stream to rapidly fill the container with bulk material. The apparatus can also be provided as a retrofit kit to convert an existing bucket into a bagging apparatus.

14 Claims, 9 Drawing Sheets

10
22
20
24
12
30
64
52
58
74
18
32
76
78
14
60
72
80
70

BULK MATERIALS BAGGER AND METHOD

FIELD OF THE INVENTION

The present invention relates to an apparatus and method for packaging bulk materials into a container. In particular the present invention relates to an apparatus and method for bagging bulk materials from a supply of bulk material.

BACKGROUND OF THE INVENTION

Materials such as sand, salt, grain, feed and the like, are often stored in bulk prior to being packaged in individual containers. For example, the bulk material may be initially stored in a pile from which a quantity of the bulk product is removed for placement into bag of a size that can be readily handled. The bags may then be transported to the location of their desired end use. A need exists for an apparatus that can rapidly and efficiently package materials that are stored in bulk.

The bagging of sand to form sandbags is one practical example of the need for the rapid packaging of a bulk material into containers. In emergency situations, such as impending flooding, the speed at which the sandbags are formed and put in place often impacts the success or failure of such efforts. Commonly, sandbags are formed manually by shoveling or scooping sand from a pile into a bag. When formed at the site of a potential flood area, the sandbags are then carried to a strategic location for final placement, such as to form a dam. Sometimes the sandbags are carried individually, and sometimes in emergency situations, the bags are passed along a human chain line from the sand pile to their final destination.

In any event, the process of manually filling the bags and carrying the sandbags from the sand pile to the point of strategic placement to form a dam is time consuming and labor intensive. Manual bagging efforts are slow, especially when filling a large number of sandbags as may be required in many situations. Moreover, such conventional efforts are inadequate when speed is of the utmost importance in attempting to preserve life and property in advance of impending flood conditions. Also, mobilization of a large crew of workers to form and transport the sandbags is not always possible, especially on short notice. Thus a need exists for an apparatus and method for rapidly forming individual sandbags from a bulk supply, and having those sandbags on hand in the location where they will provide the greatest protection against flooding.

One attempt to speed up the sand bagging process involves providing a relatively large receptacle mounted on a trailer. The receptacle is filled with sand from a sand pile. The sand can then be emptied by gravity out a bottom chute of the receptacle, while a bag is manually held open at the chute to fill the bag to form a sandbag. However, such apparatus is relatively expensive and has limited mobility. For example, since the apparatus is relatively large and needs to be pulled behind a vehicle, it is often unable to be maneuvered to remote locations of limited access, or to those locations that require travel over uneven terrain to be reached. Furthermore, such apparatus is solely dedicated to bagging purposes, and when not in use takes up a large amount of storage space.

Therefore a need exists for an apparatus and method for rapidly forming sandbags from a pile of sand and making the sandbags available at a remote site, that in many instances may be of limited and difficult access.

SUMMARY OF THE INVENTION

In accordance with one aspect of the invention an apparatus for attachment to a mobile machine for filling a container with bulk material particles held in the apparatus is provided. The apparatus includes a receptacle that has a bottom and at least a first wall.

The first wall has an opening therethrough. The apparatus also includes a bulk material particle mover for moving particles from a first location in the receptacle towards a second location adjacent the opening in the wall. The bulk material particle mover is mounted in operative relation to the opening to cause the particles to exit the receptacle through the opening for the filling of individual containers.

In accordance with another aspect of the invention the apparatus includes a bucket capable of attachment to a vehicle. The bucket has an opening in a sidewall and an auger to move bulk products held in the bucket towards the opening. The auger is horizontally positioned along the bottom of the bucket with the front end of the auger adjacent the opening. A motor rotates the auger to move the bulk material particles towards the opening and also forces the particles through the opening for packaging in a container.

In accordance with another aspect of the invention the apparatus includes a bucket that is attachable to a manually driven vehicle. The bucket includes a bulk material particle mover for moving bulk material particles that were previously placed in the bucket. The bulk material particles are moved from one location in the bucket to an opening in the first wall and are forced out the opening. The exiting bulk material particles fall into a bag to fill the bag.

In one embodiment of the invention the apparatus includes a chute attached to the sidewall adjacent the opening and an auger creates a flow stream of bulk material particles proceeding from the end of the chute, so that a bag may be filled by positioning the bag to receive the bulk material particles from the flow stream.

In another aspect of the invention the bucket is attached as a loader to a skid steer, tractor, or truck and the bucket has an open front end for scooping a load of bulk material into the bucket by moving the bucket into a pile of bulk material.

In accordance with another aspect of the invention the apparatus has a plurality of openings in the receptacle for simultaneously providing a plurality of flow streams so that a plurality of bags may be simultaneously filled. The apparatus may have a plurality of augers to direct bulk material particles held in the receptacle towards and out the openings.

In accordance with another aspect of the invention a retrofit kit for converting an existing loader bucket into an apparatus for packaging bulk product into containers is provided. The kit includes an auger, mounting brackets for mounting the auger, a motor for powering the auger and a power transmission belt for transmitting power from the motor to the auger.

In accordance with another aspect of the invention a retrofit kit for converting an existing loader bucket into an apparatus for packaging bulk product into containers is provided. The kit includes an auger, mounting brackets for mounting the auger, a hydraulic motor for powering the auger and a power transmission belt for transmitting power from the motor to the auger. The auger and the motor each include a sprocket and the kit includes a chain for placement on the sprockets to transmit power from the motor to the auger. The brackets include a bracket for mounting one end of the auger to a sidewall of the bucket, and another bracket for mounting the other end of the auger to another sidewall. The kit also includes a chute for attachment to a sidewall adjacent the opening through which the bulk material particles are exited.

In accordance with another aspect of the invention a method of filling a container with bulk material particles is provided. The method comprises providing a pile of bulk material particles and providing a mobile machine with an attached receptacle with an opening. The receptacle is provided with a machine device to move the bulk material particles from one location in the receptacle to another location within the receptacle. The bulk material particles are loaded into the receptacle, and then moved within the receptacle towards the opening in the receptacle by operation of the machine device. The bulk material particles are caused to exit out the opening, at least in part, by operation of the machine device. A container is provided and positioned adjacent the opening. The container is filled with bulk material particles exiting out of the opening.

In accordance with another aspect of the invention the method is performed by utilizing a receptacle that is a bucket attached to a vehicle and the bulk material particles are loaded in the bucket by scooping the bulk material particles into the bucket.

In accordance with another aspect of the invention the bulk material particles are sand particles, and the containers are bags that are filled with sand to form sandbags.

Typically, the method is performed by providing an auger to transport the particles to the opening in the bucket, and the bucket may include a chute positioned in operative relationship to the opening. The auger forces the sand out the opening and along the chute. A bag is aligned with the chute to fill the bag with sand to form a sandbag.

In accordance with another aspect of the invention a method is provided for scooping the bulk materials from a pile into a receptacle attached to a vehicle. The vehicle is driven from the pile to a remote location where the bulk material is exited out of the receptacle to fill containers with the bulk material at the remote location. The method eliminates, or reduces, the requirement for a crew to transport the containers to a remote location of final use.

In accordance with another aspect of the invention the apparatus includes brackets for attachment to three point hitch. The apparatus may also have a gear box for connection with a power take off device.

In accordance with another aspect of the invention the apparatus includes a sleeve providing a passageway for bulk material particles exiting through an opening in the bucket.

DETAILED DESCRIPTION OF THE INVENTION

Figure 1:
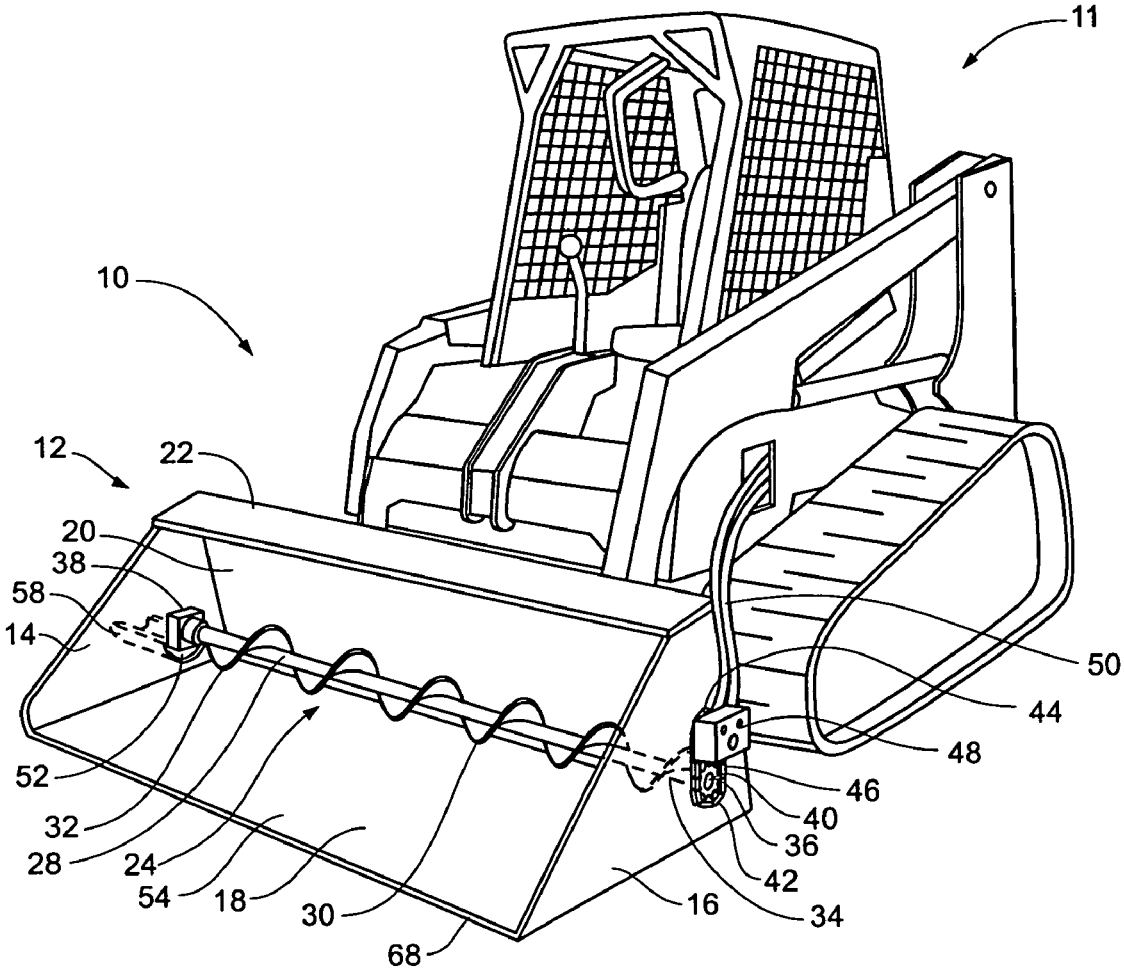
FIG. 1 is a perspective view of the apparatus of the invention.

FIG. 1 shows a bulk material bagging apparatus 10 that includes a receptacle, or bucket 12 that can be attached to a vehicle. Such vehicles may include tractors, skid steers, trucks and the like. For example, bucket 12 may be attached to a skid steer 11 to replace an existing bucket of a front end loader to thereby provide capabilities for the rapid bagging of bulk materials. Bucket 12 has sidewalls 14, 16, bottom 18 and a rear wall 20. Bucket 12 may optionally include a top 22, partially covering an otherwise open top end.

Mounted adjacent the inner juncture of bottom 18 and rear wall 20 is an auger 24. Auger 24 includes a spindle 28 with an integrally formed screw, or blades 30 extending outwardly from spindle 28. Auger 24 has a front end 32 and rear end 34. Each of auger ends 32, 34 are mounted at a mounting member 38 attached to each of sidewalls 14, 16. Mounting members 38 include bearings for allowing the free rotation of spindle 28.

The rear end 36 of spindle 28 extends though a bore 40 in sidewall 16, and has a sprocket 42 attached to spindle 28. Sprocket 42 is connected by a chain 46 to a sprocket 44 that is driven by a motor 48. Motor 48 may be a hydraulic, gas, electric or other type of motor. However, a hydraulic motor is advantageous for applications with a vehicle that has existing capabilities to provide hydraulic power, such as through hydraulic power supply hoses 50 for attachment to motor 48. The apparatus may be provided with a cover or covers (not shown for clarity) to protect sensitive parts, such as motor 48, sprockets 42, 44 and chain 46 from contact with bulk materials that are placed within bucket 12.

Figure 2:
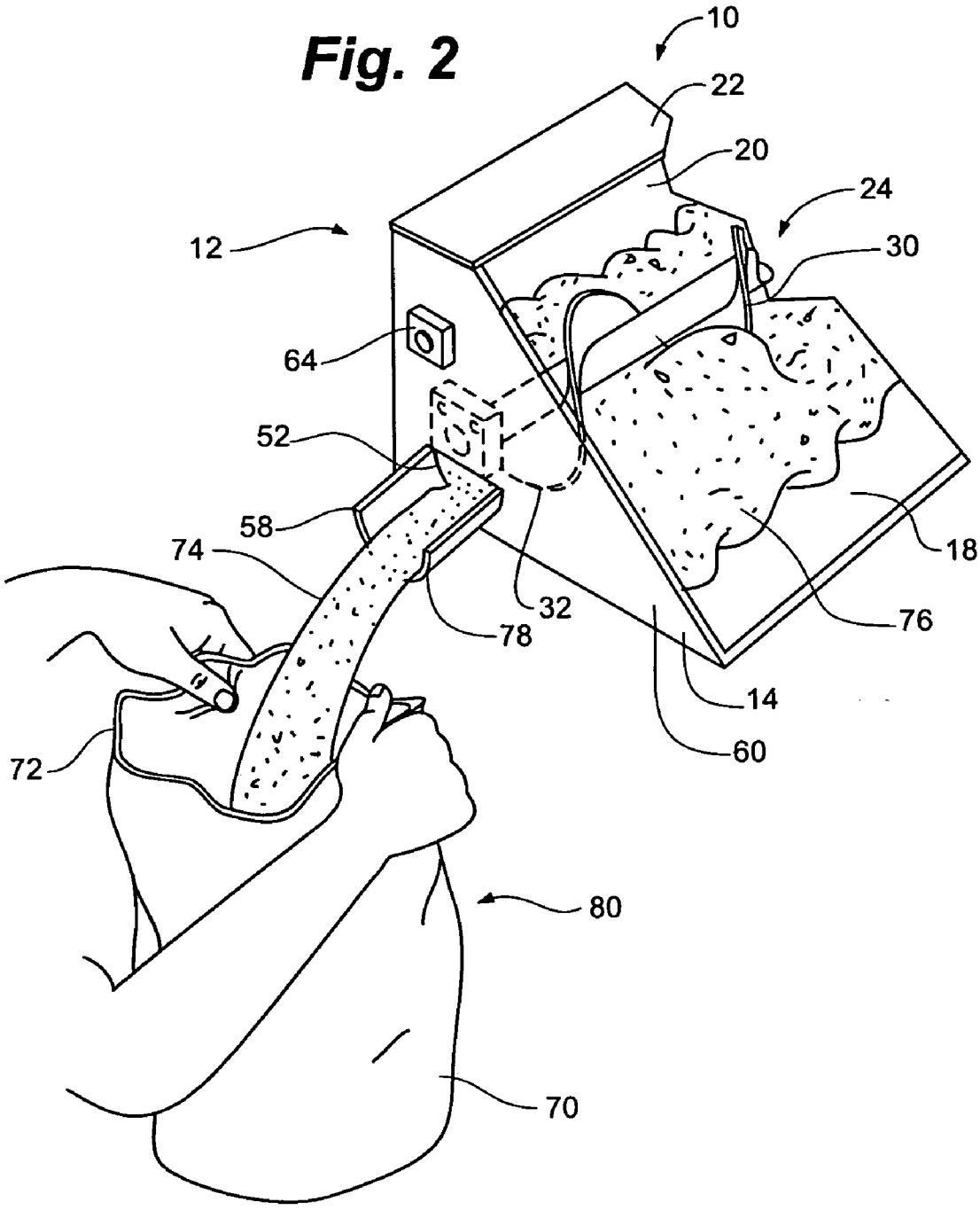
FIG. 2 is a perspective view of the apparatus being used to form a sandbag.

As best seen in FIG. 2, sidewall 14 has an opening 52 providing a passageway from the interior 54 of bucket 12 through sidewall 14. A chute 58 may be mounted to the outer surface 60 of sidewall 14, and extends outwardly therefrom. Chute 58 may be of the shape shown in FIG. 2 or it may be of other configurations such as a full pipe, or chute with flat sides and bottom.

In one mode of operation of the apparatus of the invention, bulk material bagging apparatus 10 is mounted by means known to those skilled in the art to a vehicle, such as skid steer 11. Advantageously, apparatus 10 is attached to the front end of the vehicle and the vehicle is driven towards a pile of bulk material, such as a pile of sand. As the front edge 68 of bucket 12 enters the pile of sand, a load of sand is scooped into interior 54 of bucket 12. After scooping, by operation of customary controls on the skid steer, bucket 12 may be tilted to raise up the front edge 68 of bucket 12, to thereby prevent the sand from falling out the open front end 66 of bucket 12. The vehicle may then be moved to a desired location for the formation of sandbags. This location may be a location of even footing adjacent the sand pile. The vehicle may also be moved to a remote location in the vicinity of where the sandbags will ultimately be used, such as in forming a dam around a doorway of a building in danger of flooding. When moved a longer distance, an optional slideable door (not shown) may be closed to temporarily seal off opening 52 to prevent sand from falling out of bucket 12 during transport.

To fill and form a sandbag, bucket 12 is raised to a height off the ground so that chute 58 has sufficient clearance from the ground to allow bag 70 to be conveniently filled to a desired height. Bag 70 is aligned adjacent chute 58 with the top end 72 of bag 70 manually held open to receive sand. Motor 48 is then turned on to rotate sprocket 44 and chain 46 to thereby cause rotation of sprocket 42 and auger 24. Auger screw blades 30 force sand in a direction towards front end 32 of auger 24. Auger 24 moves the sand towards opening 52, forcing the sand out opening 52 and onto chute 58, if optional chute 58 is utilized. As the sand is forced out of bucket 12, the sand remaining in bucket 12 is shifted by gravity towards the auger 24, so that auger 24 continues to move sand within bucket 12 out opening 52. In this regard, it is noted that it is advantageous to tilt bucket 12 so that auger 24 is at the lowest orientation of bucket 12. As noted above, such tilting may initially take place just after scooping the sand out of the pile to ensure that the sand remains in bucket 24 during movement of the vehicle away from the pile, in particular if filling bags at a remote location. It is also noted that a grate or screen (not shown for clarity) may be positioned adjacent auger 24 to prevent rocks and other debris, that have been inadvertently scooped into bucket 12, from being drawn into contact with auger 24. Such screen may be fabricated from expanded steel, and is also advantageous to prevent injury by blocking human contact with auger 24.

Once reaching a sufficient speed, a flow stream 74 of sand 76 proceeds from the free end 78 of chute 58, entering bag 70 to fill and thereby produce a sandbag 80. After filled to a desired height, sandbag 80 is removed from adjacent flow stream 74, while at the same time positioning a next bag 70 under flow stream 74 to begin filling the next bag. The sandbag 80 may be sealed by using a bag 70 with an extended length that is folded over to close the top opening of sandbag 80. In the alternative, bag 70 may be sealed by other methods, such as by using a tie or a drawstring, or by stitching or heat sealing the bag closed, or by the use of other methods sealing of bag 70.

Motor 48 may be allowed to run until sand is emptied from bucket 12, or turned off during replacement of empty bags 70. Motor 48 may also be turned off after the desired number of sandbags 80 have been filled. Typically, a vehicle that has a hydraulic power source also has it own on-off control within the cab of the vehicle. Hence, the operator in the vehicle may turn off the auger by utilizing such controls. Bagging apparatus 10 may have its own mechanical or electrical control 64 for turning on and off motor 48, and/or have a clutch for placing the belt drive mechanism into idle to prevent rotation of auger 24. Such on-off control 64 may be mounted to bucket 12 in a convenient location, such as adjacent opening 52, and may include a speed control when variable speed motors or mechanisms are utilized to drive auger 24.

If additional sandbags 80 are required, the vehicle is returned to the pile. With auger 24 turned off, the vehicle advances toward the sand pile to scoop additional sand into bucket 12. Thereafter the sandbag forming process is repeated until the desired number of sandbags 80 are formed.

Figure 3:
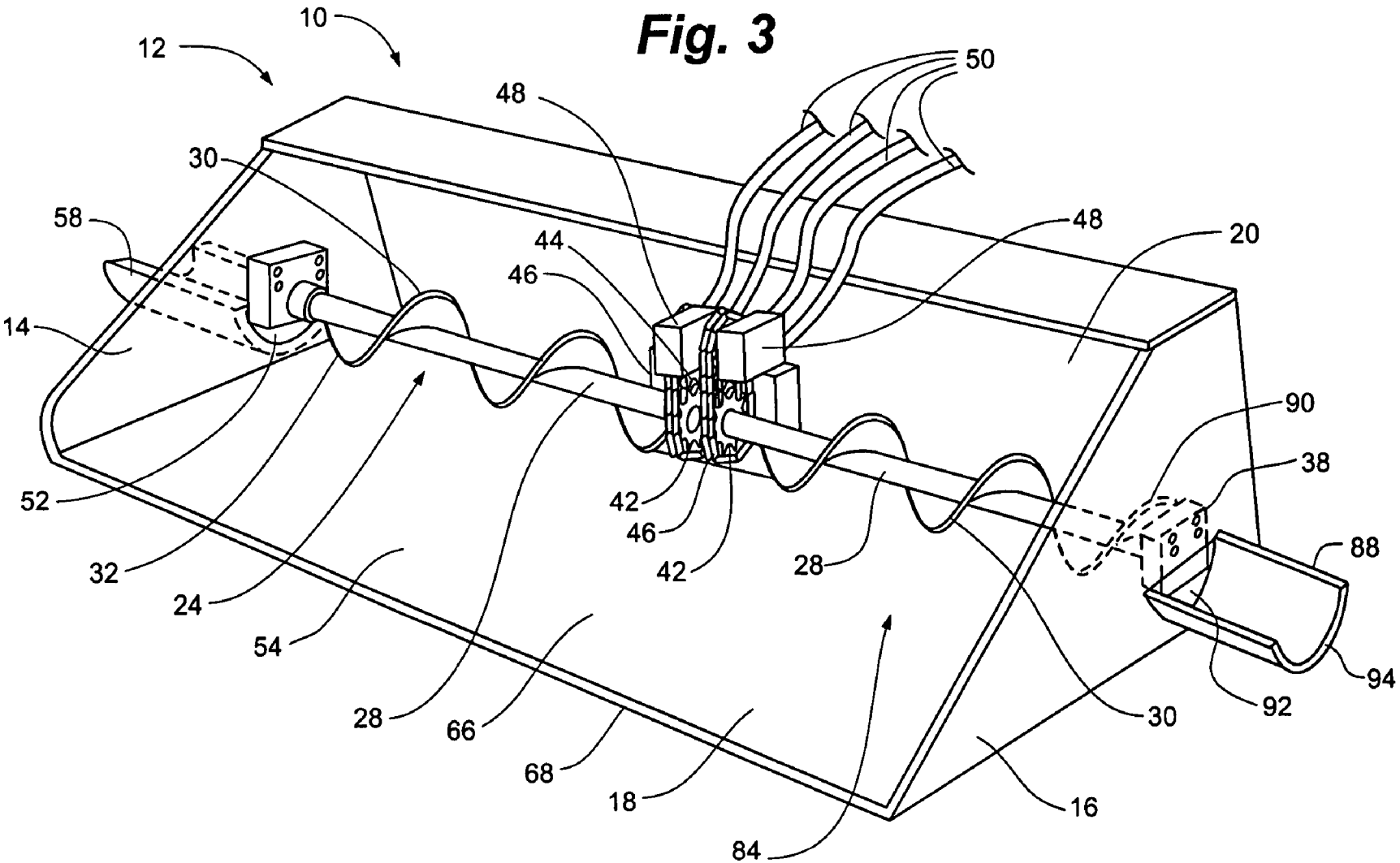
FIG. 3 is a perspective view of another embodiment of the invention showing an apparatus simultaneously forming two sandbags.

In another embodiment of the present invention, bagging apparatus 10 is provided with two or more augers to increase the speed of sandbag formation. As shown in FIG. 3, bucket 12 is equipped with a first auger 24 and a second auger 84. Each of augers 24, 84 are connected to one of the motors 48 by sprockets 42, 44 and chain 46. The front end 90 of second auger 84 is aligned with an opening 92 in sidewall 16. A second chute 88 is mounted to sidewall 16 adjacent opening 92. Rotation of second auger 84 creates another flow stream 74 of sand at free end 94 of second chute 88. Thus sandbags 80 may be simultaneously formed at both flow streams 74, exiting from both chutes 58, 88.

Optionally, both augers 24 and 84 may be arranged to operate off a common motor 48 by the sprocket and chain arrangement of the type previously described. One of the augers 24 or 82 may be equipped with right handed screw threads, while the other auger has left handed screw threads, so that each of the augers forces sand in an outward direction toward either chute 58 or chute 88.

Figure 10:
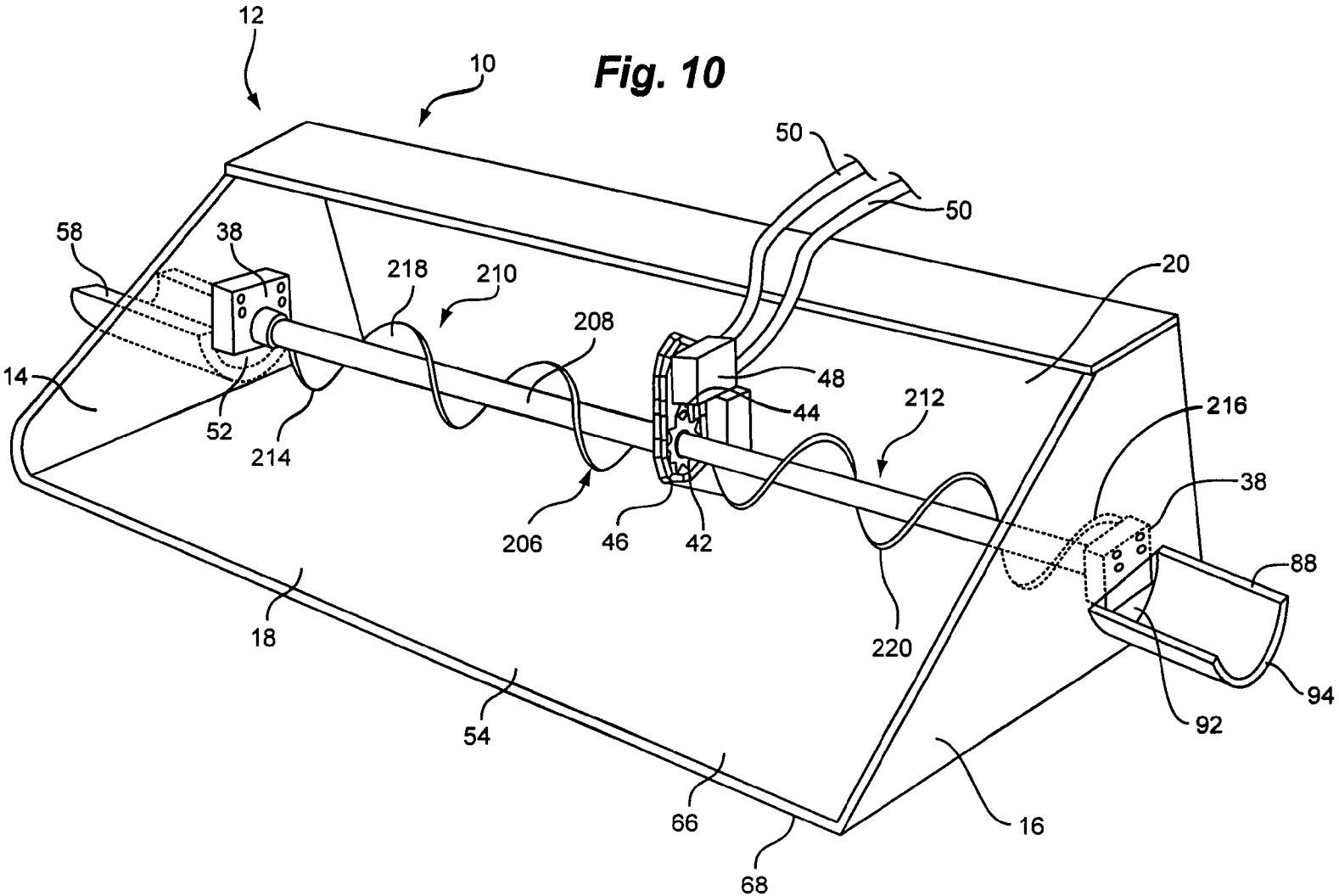
FIG. 10 is a perspective view of yet another embodiment of the invention showing an apparatus for simultaneously forming two sandbags.

In another embodiment of the invention shown in FIG. 10, a two-sided auger 206 having a single spindle 208 is used to force sand out chutes 58 and 88 by providing one side 210 of spindle 208 with right handed screw blades 218, and the other side 212 of spindle 208 with left handed screw blades 220. Right handed screw blades 218 force sand out opening 52 in sidewall 14, aligned with end 214 of auger 206, while left handed screw blade 220 forces sand out opening 92 in sidewall 16, aligned with end 216 of auger 206. Auger 206 is connected to motor 48 by sprockets 42, 44 and chain 46 in a manner similar to augers 24 and 84 in the embodiment illustrated in FIG. 3. It is noted that is it also possible to configure apparatus 10 so that augers feed sand out two or more sufficiently spaced apart chutes attached to the same sidewall 14 or 16, of bucket 24.

Thus the bulk material bagging apparatus 10 provides for a rapid formation of sandbags 80 that is estimated to be on the order of 50 times faster than conventional methods. Moreover, the sandbags 80 may be formed at a remote location. For example a pile of sand may be deposited in the front driveway of a house. Bucket 12 may be attached to a vehicle, such as a Bobcat skid steer 11, to allow a load of bulk material to be rapidly scooped into bucket 12. The Bobcat 11 can then be driven to a remote location, such as the back door of the house, and the bulk material bagging apparatus 10 may then be utilized to rapidly form sandbags 80 at a location adjacent the doorway. As the sandbags 80 are formed they may be put in place around the doorway to form a dam of sandbags 80 to prevent flooding of the building. Not only may dams be rapidly built at remote and multiple strategic locations, they can be formed without the need of a relatively large crew of workers. Hence, it can be appreciated that a long chain of workers is not needed to pass sandbags being of formed at the sand pile to strategic locations about the property.

Figure 4:
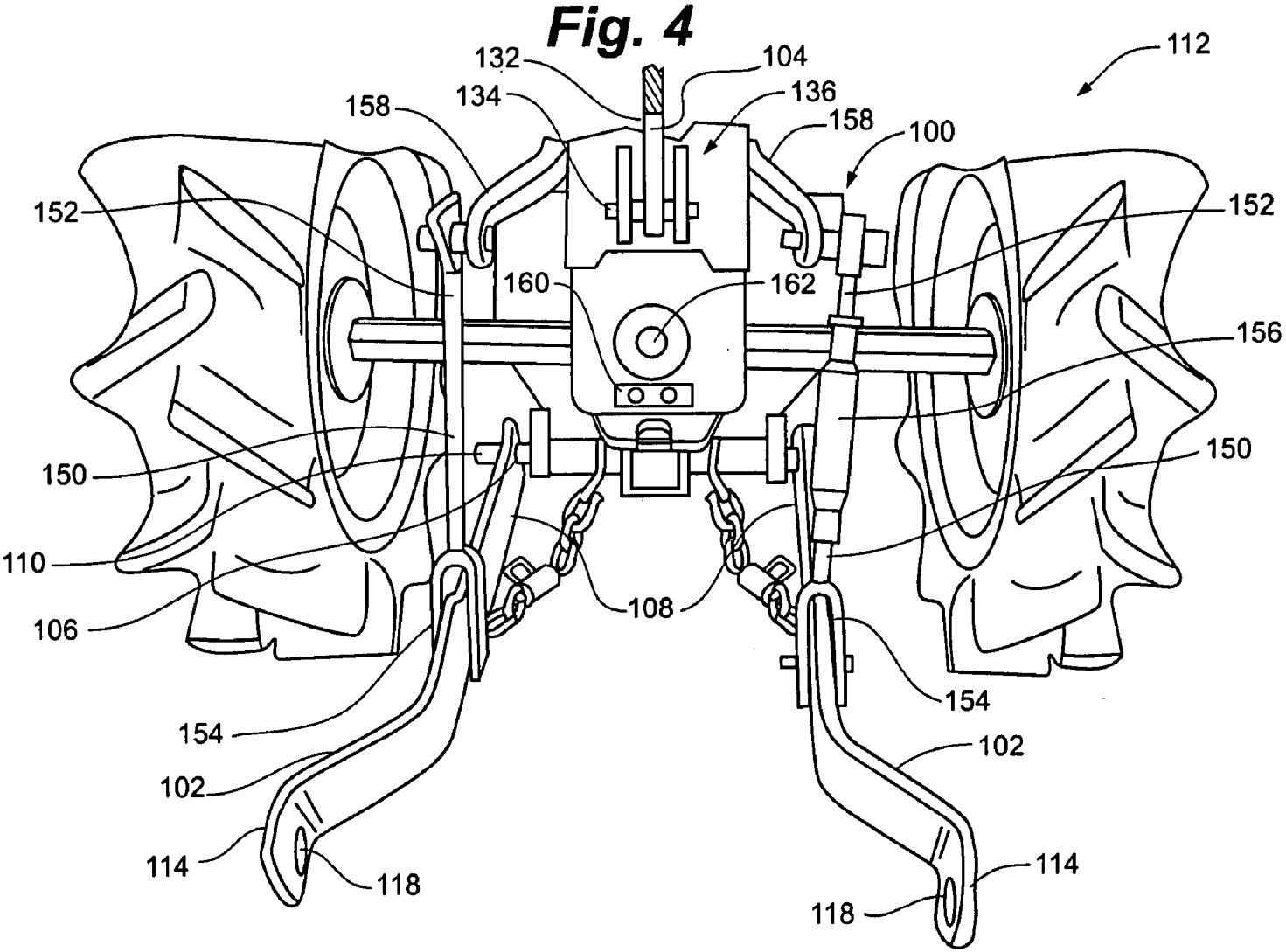
FIG. 4 is a perspective view of a three point hitch for mounting the apparatus of the invention to a tractor.
Figure 5:
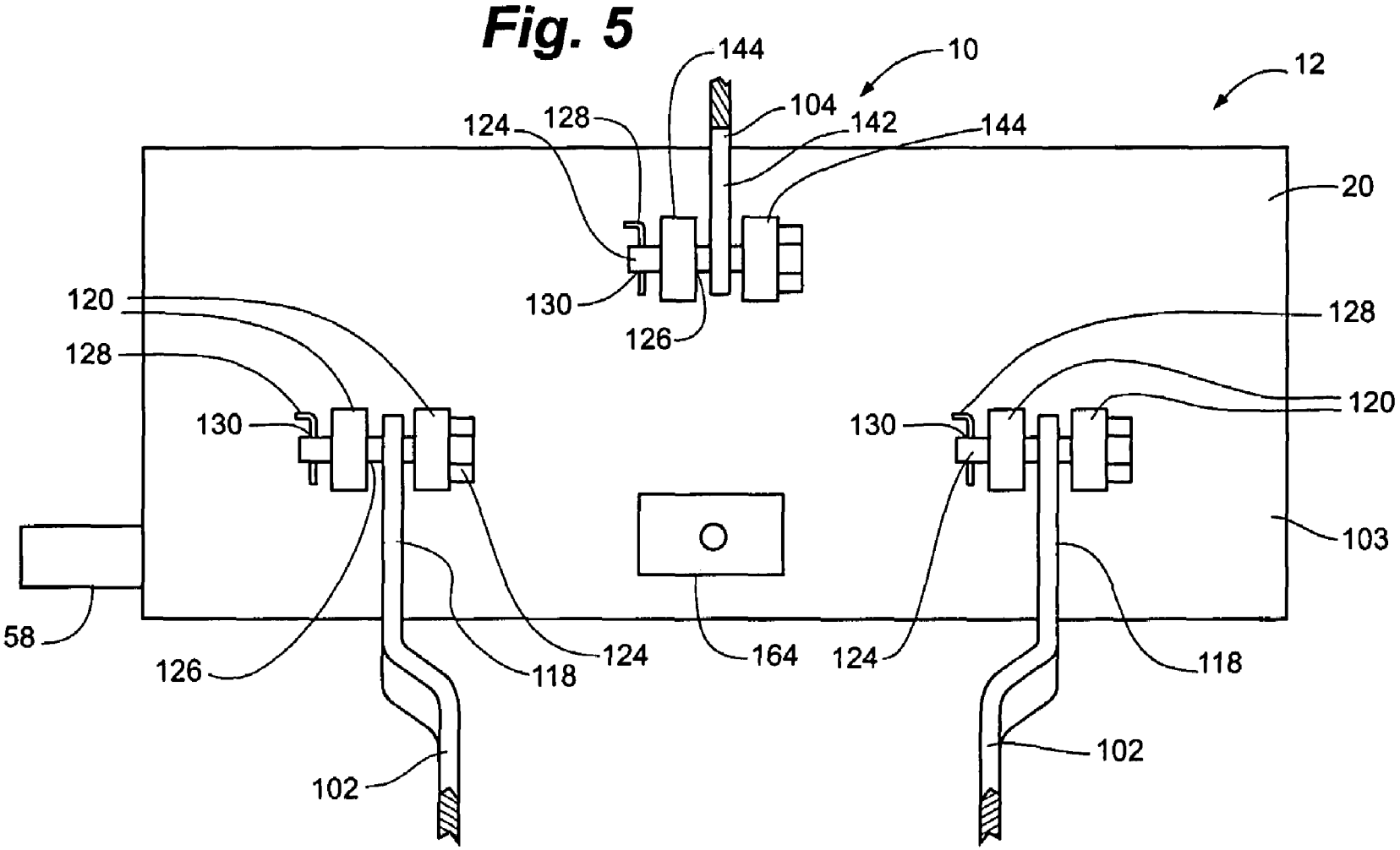
FIG. 5 is a rear view of the apparatus of invention showing mounting brackets for mounting to a three point hitch.
Figure 6:
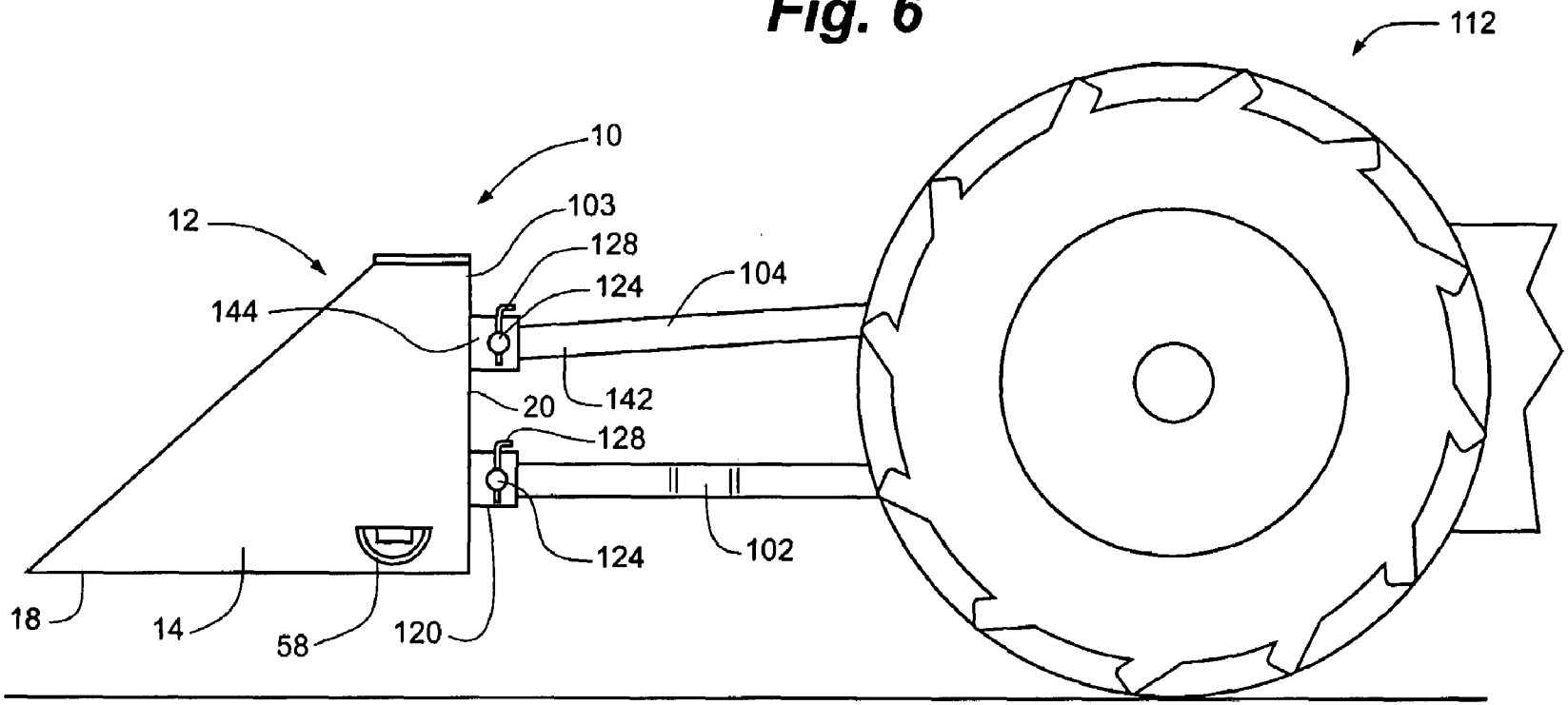
FIG. 6 is side view of the showing the apparatus of the invention mounted to a three point hitch of a tractor.

As mentioned previously, bulk material bagging apparatus 10 may be used with vehicles other than skid steers. For certain vehicles it may be advantageous to attach bucket 12 by means of a vehicle's three point hitch device. FIGS. 4-6 show a typical three point hitch 100 as used to mount bucket 12 to the back of a tractor 112. Three point hitch 100 provides three points of attachment for bucket 12 of bulk material bagging apparatus 10. Two points of attachment are provided by a pair of lower links 102. A third point of attachment is provided by a top link 104.

Lower links 102 each have a rear end 108 with a hole 106 therethrough for mounting to a rod 110 on tractor 112. The front end 114 of lower links 102 have holes 118 for mounting to brackets 120 on the rear surface 103 of rear wall 20 of bucket 12. After front end 114 is inserted into bracket 120, a pin 124 is inserted through openings 126 in bracket 120 to secure bucket 12 to lower links 102. Pin 124 is secured in place by a cotter pin 128 that is removably inserted into a hole 130 in pin 124.

The rear end 132 of top link 104 is secured in place to a rod 134 held by top link mounting member 136 of three point hitch 100. The front end 142 of top link 104 is positioned in a top bracket 144 on bucket rear surface 103, and is secured thereto with pin 124 and cotter pin 128. Top bracket 144 may alternatively be located on the top 22 of bucket 12.

As seen in FIG. 4, three point hitch 100 may also include vertical links 150 that are yoked to each of lower links 102 at end 152. Vertical links 150 may have one or more lower link height adjustors 156 for adjusting the height of lower links 102. The other end 154 of vertical links 150 is attached to lifting arms 158 of three point hitch 100. Lifting arms 158 are operated by a hydraulic cylinder (not shown), as is known in the art, to raise, lower and tilt bucket 12.

Hydraulic hoses 50 of apparatus 10 can be connected to a source of hydraulic fluid power from tractor 112, such as at hydraulic connection 160. The other end of hoses 50 are connected to hydraulic motor 48 of bagging apparatus 10, as described previously. Alternatively, auger 24 may also be powered by a power take off, or PTO shaft 162 of tractor 112 by use of a gear box 164 to connect shaft 162 to auger 24. By connecting one side of the gear box to PTO shaft 162 and the other side to auger 24, bulk material apparatus 10 may be powered by PTO shaft 162 without requiring use of motor 48.

Figure 7:
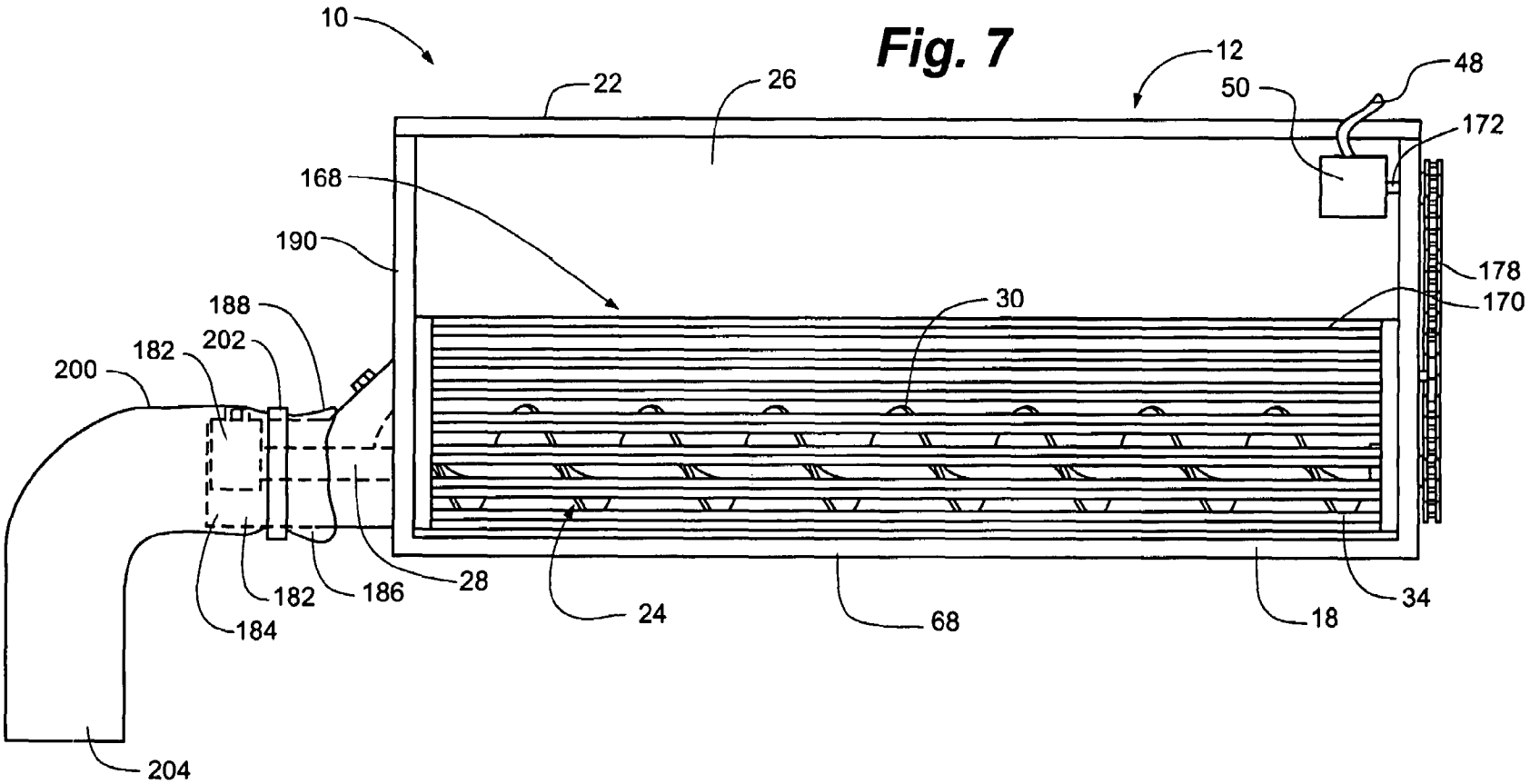
FIG. 7 is a front view of another embodiment of the apparatus of the invention showing a flexible sleeve.
Figure 8:
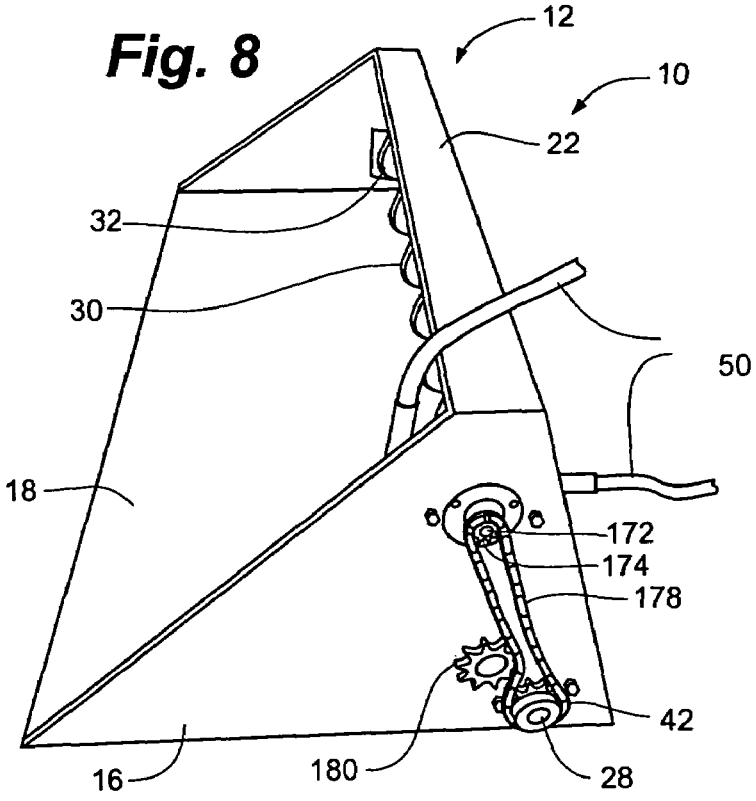
FIG. 8 is side perspective view of alternative position for mounting the motor.
Figure 9:
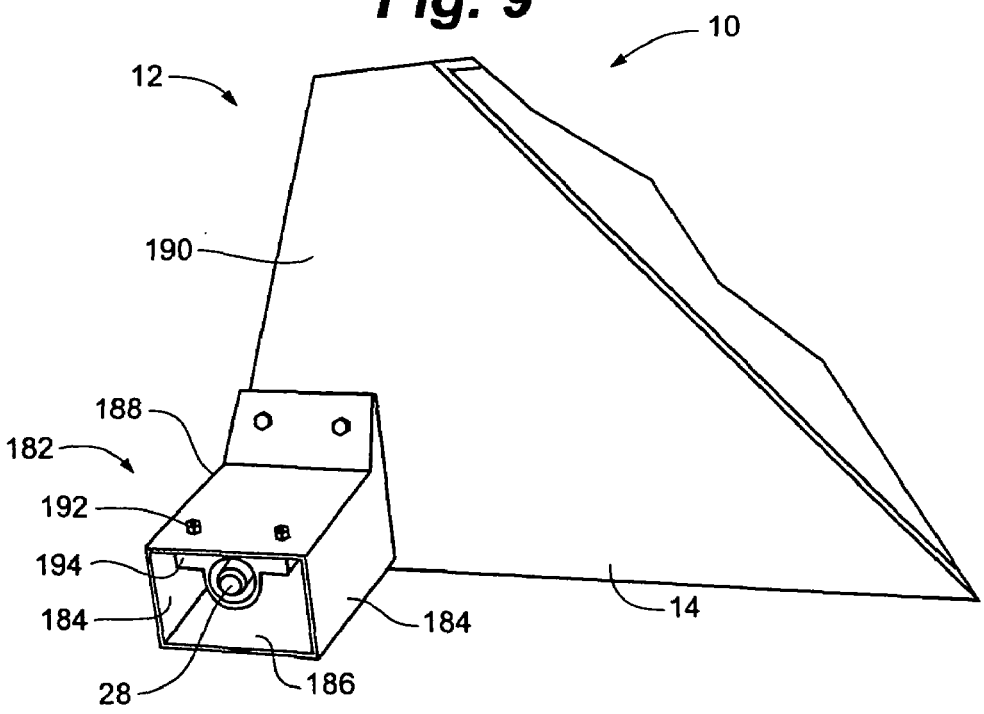
FIG. 9 is a partial side perspective view of showing an alternative chute and auger bearing.

A further embodiment of apparatus 10 is illustrated in FIGS. 7-9. In this embodiment apparatus 10 has shield, or grate, 168 to cover auger 24. Grate 168 is secured to rear wall 20 and bottom 18 of bucket 12, and extends over auger 24 to prevent injury by auger 24. Grate 168 has horizontal bars 170, that also act to prevent rocks or other debris, inadvertently mixed in with the bulk material, from reaching auger 24. Shield 168 could also be provided with vertical bars, or be formed in any other suitable manner, including from heavy duty screening or expanded steel, for example.

FIGS. 7-9 also illustrate placement of motor 48 inside bucket 12. Hoses 50 connecting motor 48 to a hydraulic power supply on vehicle 11, can extend through a hole in bucket 12 rear wall 20, or extend over bucket top 22. Bucket 12 may be provided with a cover (not shown for clarity) to protect hoses 50, motor 48, or both. In FIG. 8 motor shaft 172 is seen extending through sidewall 16. A motor sprocket 174 is connected to auger spindle sprocket 42 by chain 178 to transmit power to auger 24. A chain tensioning device 180 may be provided for adjusting the tension of chain 178.

In FIGS. 7 and 9 an alternative chute 182 is shown. Chute 182 is generally rectangular shaped, having flat sides 184, bottom 186 and top 188. Chute 182 is mounted to the outside surface 190 of bucket sidewall 14 by bolts 192. A mounting bearing 194 for auger 24 is mounted to chute top 188 by bolts 198.

FIG. 7 shows a sleeve 200 attached to chute 182 by clamp 202. Sleeve 200 may be formed of a flexible vinyl plastic material. Bulk material particles are forced by auger 24 out chute 182, through sleeve 200 and out sleeve exit opening 204. The use of sleeve 200 is advantageous in directing a flow stream of bulk particles from exit opening 204 into a bag or other container.

The packaging apparatus of the present invention may also be provided in the form of a kit to retrofit an existing receptacle, such as a bucket 12, used as a front end loading bucket 12 of a skid steer, tractor or the like. Such bucket 12 is first formed with an opening 52, if such an opening or similar opening is not pre-existing on the bucket to be retrofitted. The retrofit kit may include auger 24, motor 48, and power chain 46. The kit may also include any other components of apparatus 10, such as chute 58 or 182, and mounting brackets, such as mounting members 38, for mounting auger 24 to bucket 12.

While the present invention has primarily been described in relation to the formation of sandbags, it is emphasized that the scope of the invention is in no way limited solely to the formation of sand bags. For example any other bulk material such as salt, feed and grain can be bagged by the apparatus and method of the present invention. Moreover, the invention need not be limited in scope to the filling of bags. Depending on the application, it may be desirable to use apparatus 12 to fill other types of containers such as, for example, pails, cans and drums. Additionally, the containers of bulk materials may be formed at a location that is remote from the supply of the bulk material, so that the individual containers may more readily be available for use or storage at such location.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

The invention claimed is:

1. An apparatus for attachment to a mobile machine and for filling a container with bulk material particles held in the apparatus comprising:

a receptacle, the receptacle having a bottom, a first wall, and a second wall, a first opening in the first wall, a second opening in the second wall, a first auger positioned within the receptacle for moving bulk material particles from a location in the receptacle towards a first location adjacent the first opening, the first auger mounted in operative relation to the first opening to cause the bulk material particles to exit the receptacle through the first opening, and a second auger positioned within the receptacle for moving bulk material particles from a location in the receptacle towards a second location adjacent the second opening, the second auger mounted in operative relation to the second opening to cause the bulk material particles to exit the receptacle through the second opening, wherein the first and the second auger are configured to rotate independently of each other.

2. The apparatus according to claim 1 wherein the receptacle is a bucket capable of attachment to a vehicle.

3. The apparatus according to claim 2 wherein the first and the second auger are positioned along the bottom of the bucket and mounted to the bucket, and the apparatus includes a first and a second independent motor for independently rotating the first and the second auger, respectively, to selectively move the bulk material particles towards the first opening, the second opening, or both openings simultaneously and force the bulk material particles through the selected opening.

4. The apparatus according to claim 3 wherein the first wall is a sidewall, and the bucket has a second sidewall, and a rear wall and a bottom, with the bucket having at least a partially open top and at least a partially open front end for scooping particles into the bucket by movement of the front of the bucket into a pile of bulk material particles.

5. The apparatus according to claim 1 wherein the receptacle is a bucket attachable to a manually driven vehicle and the augers are configured to move bulk material particles from a location in the bucket to the openings and to force the bulk material particles out the openings so that the bulk material particles may fall into a container to thereby fill a container.

6. The apparatus according to claim 1 further characterized by the receptacle including brackets for mounting to a three point hitch.

7. The apparatus of claim 6 further characterized by the receptacle including a rear wall having a rear surface, and at least one of the brackets for mounting the bucket to a three point hitch is positioned on the rear surface of the rear wall.

8. A retrofit kit for installation in an existing loader bucket for attachment to a vehicle, the bucket having a first and a second sidewall, a bottom wall and a rear wall, the first sidewall having a first opening therethrough and the second sidewall having a second opening therethrough, the retrofit kit for adapting the bucket to fill a container positioned outside the bucket and adjacent the first or the second opening with bulk material particles temporarily held in the bucket by moving the bulk material particles held in the bucket towards and out the opening and into the container comprising:

a first and a second auger, each auger having a first end and a second end, the augers adapted to be mounted along the bottom wall of a bucket with the first end of the first auger in operative relationship with the first opening in the first sidewall and for moving bulk material particles held in the bucket towards and out the first opening in the first sidewall and the first end of the second auger in operative relationship with the second opening in the second sidewall and for moving bulk material particles held in the bucket towards and out the second opening in the second sidewall, a first motor for turning the first auger, a second motor for turning the second auger, and mounting brackets for mounting the augers to the bucket.

9. A method of filling a container with bulk material particles from a supply of bulk material particles comprising:

providing a mobile machine with a receptacle attached thereto, the receptacle having a first and a second opening, providing the receptacle with a first auger positioned within the receptacle to move the bulk material particles from one location in the receptacle to another location within the receptacle adjacent the first opening and a second auger positioned within the receptacle to move the bulk material particles from one location in the receptacle to another location within the receptacle adjacent the second opening, the first and the second auger adapted to rotate independently of each other, loading the bulk material particles into the receptacle, moving the bulk material particles within the receptacle towards a selected opening in the receptacle by rotating the first or the second auger, exiting the bulk material particles out the selected opening at least in part by operation of the first or the second auger, providing a container, positioning the container adjacent the selected opening, and filling the container with bulk material particles exiting out of the selected opening.

10. The method of claim 9 further characterized by:

the receptacle being a bucket and the mobile machine being a vehicle with the bucket attached to the vehicle, and the loading comprising scooping the bulk material particles into the bucket.

11. The method of claim 10 further characterized by:

providing the bulk material particle supply in the form of a pile of sand, the loading comprising moving the bucket into the pile of sand to scoop the sand into the bucket, the filling step comprises filling a container that is a bag with sand to form a sandbag, and removing a filled sandbag from a position adjacent the selected opening.

12. The method of claim 11 further characterized by:

providing the bucket with a first sidewall with the first opening positioned in the first sidewall and passing through the first sidewall and a second sidewall with the second opening positioned in the second sidewall and passing through the second sidewall, rotating a selected auger to move the sand particles, providing a chute positioned in operative relationship with the selected opening, passing the sand along the chute, and aligning the bag and the chute to fill the bag with sand to form the sandbag.

13. The method of claim 10 further characterized by:

simultaneously moving bulk material particles out the first and the second openings to simultaneously fill a first and a second container at the first and the second opening, respectively.

14. The method according to claim 10 further characterized by:

moving the vehicle from a first location adjacent the pile to a second location that is remote from the first location after the bulk material particles have been scooped into the bucket, and performing the container filling step at least partially at the second location.

* * * * *